US009731188B2

(12) United States Patent
Yeh

(10) Patent No.: US 9,731,188 B2
(45) Date of Patent: Aug. 15, 2017

(54) ADJUSTABLE ROLLER SKATE

(71) Applicant: Ching-Ho Yeh, Taichung (TW)

(72) Inventor: Ching-Ho Yeh, Taichung (TW)

( * ) Notice: Subject to any disclaimer, the term of this patent is extended or adjusted under 35 U.S.C. 154(b) by 0 days.

(21) Appl. No.: 15/362,786

(22) Filed: Nov. 28, 2016

(65) Prior Publication Data

US 2017/0072289 A1 Mar. 16, 2017

(51) Int. Cl.
*A63C 17/00* (2006.01)
*A63C 17/02* (2006.01)
*A63C 17/14* (2006.01)

(52) U.S. Cl.
CPC ..... *A63C 17/0086* (2013.01); *A63C 17/02* (2013.01); *A63C 17/1436* (2013.01); *A63C 2017/1463* (2013.01)

(58) Field of Classification Search
CPC . A63C 17/0086; A63C 17/02; A63C 17/1436; A63C 2017/1463; A63C 17/045
See application file for complete search history.

(56) References Cited

U.S. PATENT DOCUMENTS 330,652 A * 11/1885 Whitaker ..... A63C 17/0086 280/11.26
2,170,162 A * 8/1939 Segal ..... A63C 17/02 280/11.26
3,635,854 A * 1/1972 Martin ..... A63C 17/02 280/11.26
3,993,318 A * 11/1976 Rothmayer ..... A63C 17/0086 280/11.26
4,684,140 A * 8/1987 Olivieri ..... A63C 17/0086 280/11.26
5,421,596 A * 6/1995 Lee ..... A63C 17/0086 280/11.19
5,484,149 A * 1/1996 Lee ..... A63C 17/061 280/11.231
5,620,190 A * 4/1997 Maggiore ..... A63C 17/0086 280/11.201
6,497,420 B2 * 12/2002 Ricci ..... A43B 1/0072 280/11.16
7,121,561 B2 * 10/2006 Green ..... A63C 17/0046 280/11.19
7,175,186 B2 * 2/2007 Lin ..... A63C 17/06 280/11.26
8,029,003 B2 * 10/2011 Chen ..... A63C 17/0086 280/11.221
8,918,602 B2 * 12/2014 Antani ..... G06F 12/121 711/133
9,056,241 B2 * 6/2015 Green ..... A63C 17/004
(Continued)

*Primary Examiner* — Hau Phan

(57) ABSTRACT

An adjustable roller skate is provided with a lower frame including a toe stop; a wheel assembly secured to the lower frame; an upper frame including a groove, a trough disposed rearward of the groove, a channel at a rear end, and a seat disposed in the trough and having a recess communicating with the channel; an adjustment mechanism including an externally threaded shaft disposed in both the channel and the recess, and a handle pivotably secured to a rear end of the externally threaded shaft and disposed externally of the upper frame; a sole including a toe cap, an internally threaded member on an underside of a rear end and threadedly secured to the externally threaded shaft, and a stem on the underside and slidably disposed in the groove; and a shoe disposed around an edge of the sole with the toe cap concealed.

1 Claim, 4 Drawing Sheets

(56) References Cited

U.S. PATENT DOCUMENTS

| | | | | |
|---|---|---|---|---|
| 2003/0141679 | A1* | 7/2003 | Hong | A63C 1/26<br>280/11.26 |
| 2006/0006616 | A1* | 1/2006 | Sauter | A43B 3/26<br>280/11.221 |

* cited by examiner

ADJUSTABLE ROLLER SKATE

BACKGROUND OF THE INVENTION

1. Field of the Invention

The invention relates to roller skates and more particularly to such a roller skate having a thread based length adjustment mechanism.

2. Description of Related Art

Adjustable roller skates are well known. For example, a conventional adjustable roller skate comprises a length adjustable two-section type shoe. Its adjustment mechanism is prone to malfunction.

Another conventional adjustable roller skate comprises a heel platform longitudinally rearward of a toe platform, one platform formed with a longitudinal extension telescoping in the other platform; respective front and rear axles carried on the platforms; a respective angled outer arm on each platform having a lower end carrying the respective axle, the arms being limitedly flexible for limited vertical movement of the respective axles; a respective angled inner arm on each platform lying within and above the respective outer arm and having a lower end spaced vertically above the lower end of the respective outer arm; respective abutments on the platforms spaced above the lower ends of the respective inner arms and each adapted to engage with the lower end of the respective inner arm on upward deflection of same; respective front and rear wheels carried on the axles; respective toe and heel retainers on the platforms shaped to engage around the toe and heel of a foot on the skate; at least one strap engaged with the retainers and adapted to engage over the foot in the retainers to secure same in place therein; a longitudinal row of teeth formed on the extension; an elastic tongue longitudinally secured onto the other platform and formed with teeth, the tongue being displaceable between a locked position with its teeth engaged in the teeth of the extension and thereby securing the two platforms against relative longitudinal displacement and a free position with its teeth disengagement from the teeth of the extension and the two platforms relatively longitudinally displaceable; and a latch on the other platform for displacing the tongue between its positions and for releasably holding it in the locked position.

While the device enjoys its success in the market, continuing improvements in the exploitation of adjustable roller skate of this type are constantly being sought.

SUMMARY OF THE INVENTION

It is therefore one object of the invention to provide a roller skate comprising a lower frame including a toe stop; a wheel assembly secured to the lower frame and including two axles and four wheels rotatably disposed on the axles; an upper frame including a groove, a trough disposed rearward of the groove, a channel at a rear end, and a seat disposed in the trough and having a recess communicating with the channel; an adjustment mechanism including an externally threaded shaft disposed in both the channel and the recess, and a handle pivotably secured to a rear end of the externally threaded shaft and disposed externally of the upper frame; a sole including a toe cap, an internally threaded member on an underside of a rear end and threadedly secured to the externally threaded shaft, and a stem on an intermediate portion of the underside and slidably disposed in the groove; and a shoe disposed around an edge of the sole with the toe cap concealed; wherein a clockwise rotation of the handle moves both the internally threaded member and the stem.

The above and other objects, features and advantages of the invention will become apparent from the following detailed description taken with the accompanying drawings.

DETAILED DESCRIPTION OF THE INVENTION

Figure 1:
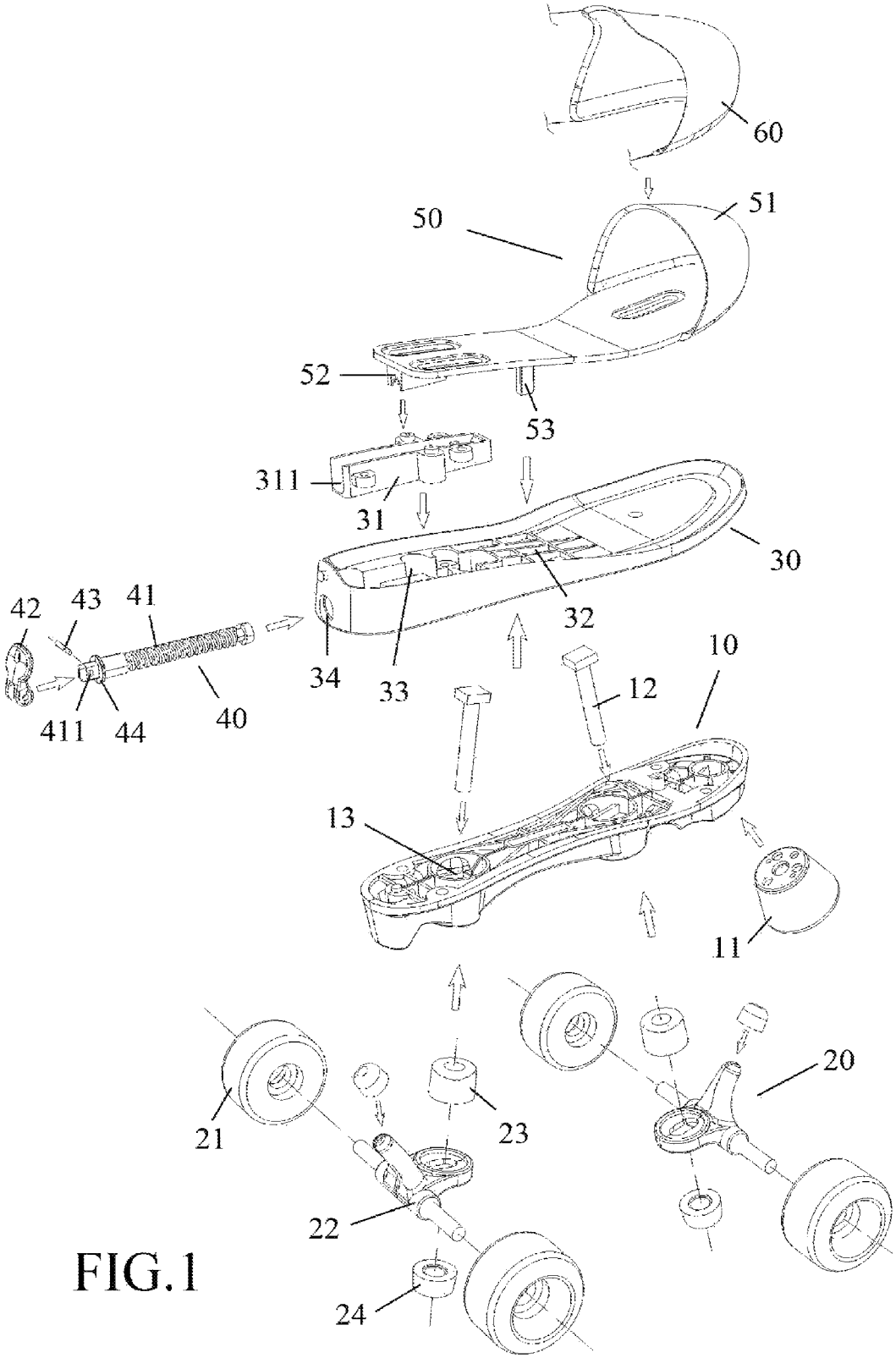
FIG. 1 is an exploded view of a roller skate according to the invention.
Figure 2:
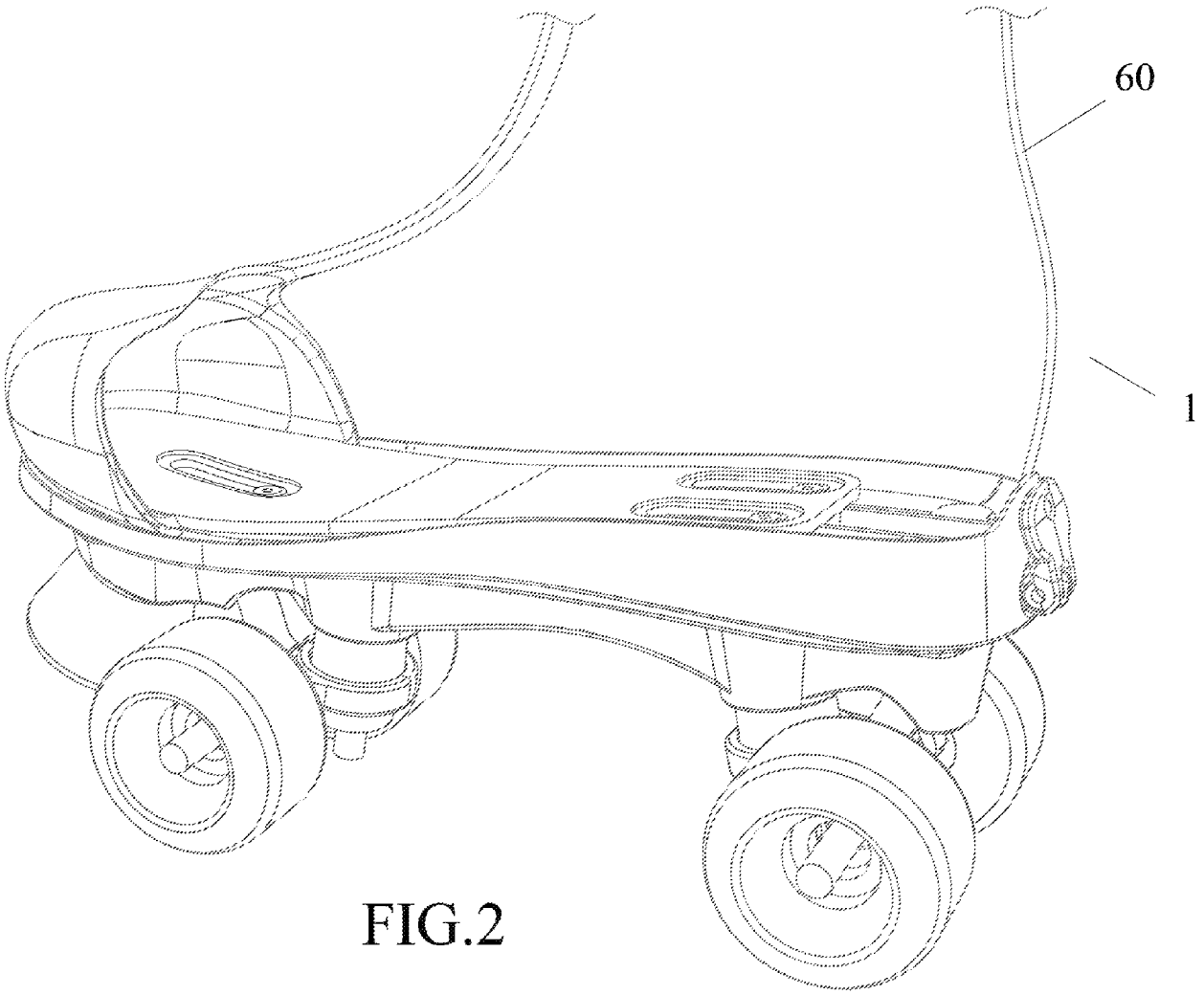
FIG. 2 is a perspective view of the assembled roller skate.

Referring to FIGS. 1 to 4, a roller skate 1 according to the invention comprises a lower frame 10 including a toe stop 11 and two holes 13; and a wheel assembly 20 including two axles 22 and four wheels 21 rotatably disposed on the axles 22. Two fasteners 12 are driven through the holes 13, two spacers 23, and two fastening members 24 to fasten the lower frame 10 and the wheel assembly 20 together.

The roller skate 1 further comprises an upper frame 30 including a groove 32, a trough 33 rearward of the groove 32, a channel 34 at a rear end, and a seat 31 disposed in the trough 33 and having a recess 311 communicating with the channel 34; and an adjustment mechanism including an externally threaded shaft 41 having a transverse hole 411 at a rear end, a handle 42 pivotably secured to the externally threaded shaft 41 by mounting a pin 43 through the handle 42 and the transverse hole 411, and a rear flange 44 disposed on the mouth of the channel 34 when the externally threaded shaft 41 is disposed in both the channel 34 and the recess 311.

The roller skate 1 further comprises a sole 50 including a toe cap 51, an internally threaded member 52 on an underside of a rear end, and a stem 53 on an intermediate portion of the underside and slidably disposed in the groove 32. A shoe 60 is disposed around an edge of the sole 50 with the toe cap 51 concealed. A foot 70 of a wearer can be covered by the shoe 60.

Figure 3:
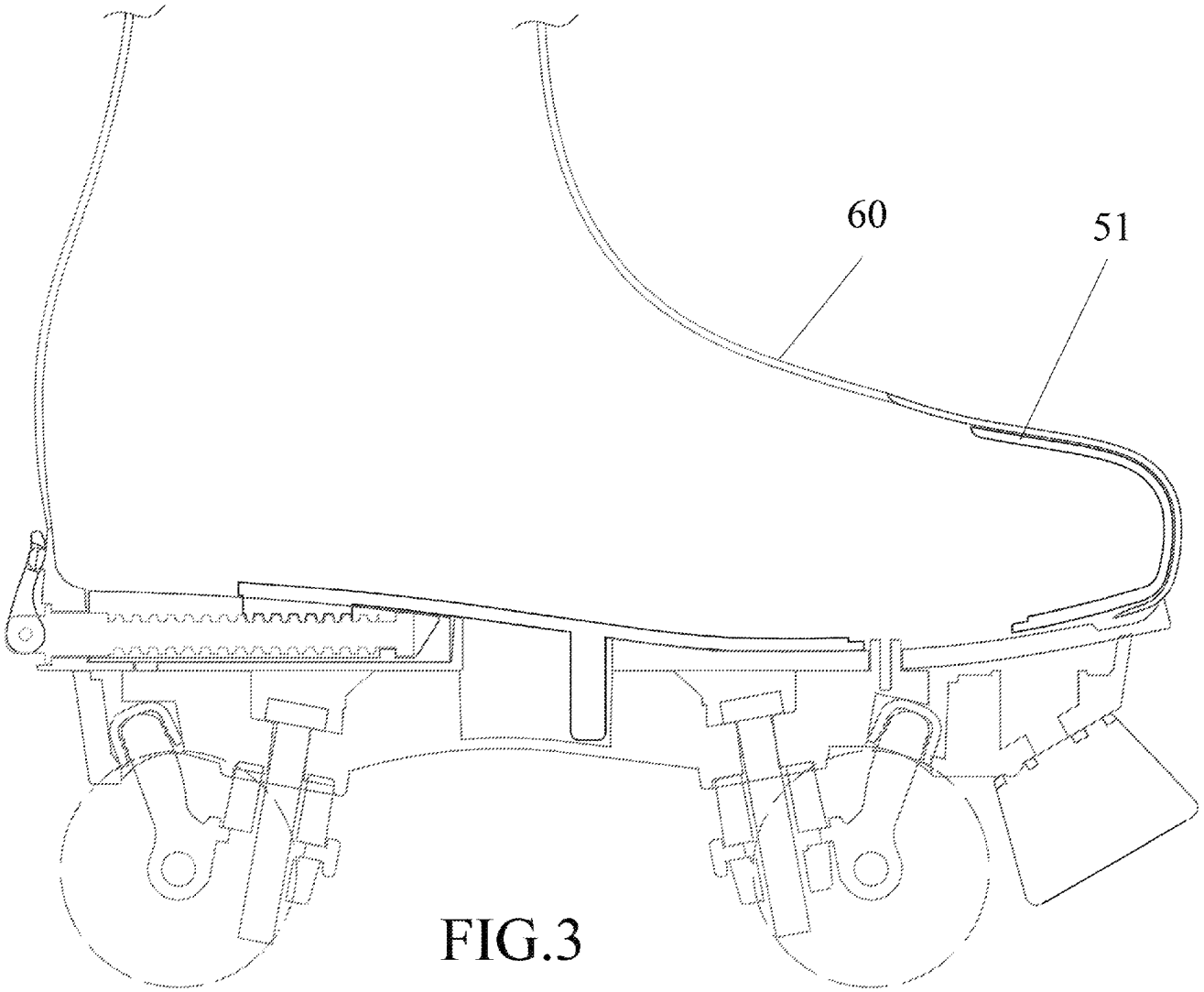
FIG. 3 is a side elevation of the roller skate of FIG. 2 with a shoe mounted thereon.
Figure 4:
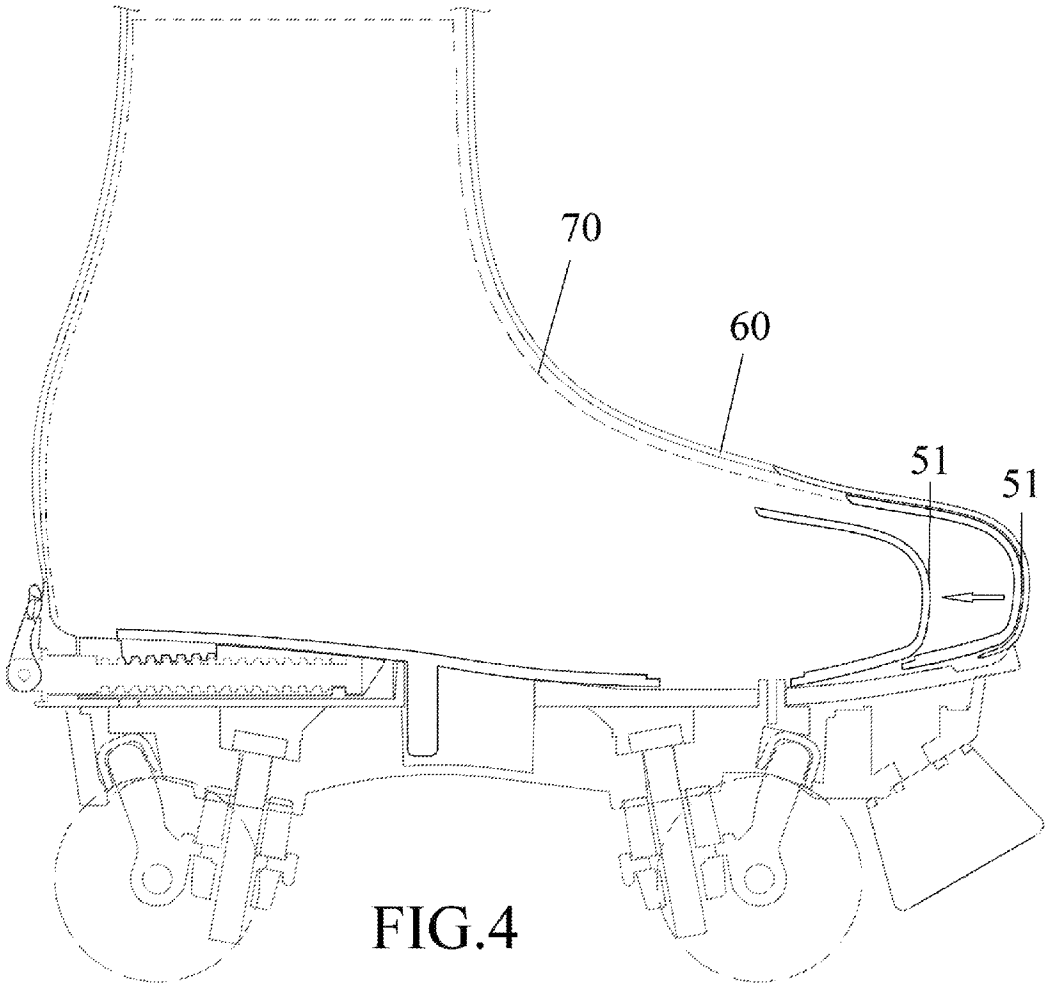
FIG. 4 is a view similar to FIG. 3 showing the toe cap moved rearward after operating the adjustment mechanism.

In an assembled state, the externally threaded shaft 41 is threadedly secured to the internally threaded member 52 and the distance from the toe cap 51 to the handle 42 is a maximum, i.e., maximum size of the roller skate (see FIG. 3).

In an adjustment operation, an individual may clockwise rotate the handle 42 to move the internally threaded member 52 (i.e., sole 50) rearward and move the stem 53 rearward along the groove 32 until being stopped. At this position, the distance from the toe cap 51 to the handle 42 is a minimum, i.e., minimum size of the roller skate (see FIG. 4). It is understood that the size of the roller skate can be adjusted to a size between the maximum size and the minimum size. Thus, the adjustment is made easy. Further, the adjustment mechanism of the invention is reliable.

While the invention has been described in terms of preferred embodiments, those skilled in the art will recognize that the invention can be practiced with modifications within the spirit and scope of the appended claims.

What is claimed is:

1. A roller skate comprising:

a lower frame including a toe stop;

a wheel assembly secured to the lower frame and including two axles and four wheels rotatably disposed on the axles;

an upper frame including a groove, a trough disposed rearward of the groove, a channel at a rear end, and a seat disposed in the trough and having a recess communicating with the channel;

an adjustment mechanism including an externally threaded shaft disposed in both the channel and the recess, and a handle pivotably secured to a rear end of the externally threaded shaft and disposed externally of the upper frame;

a sole including a toe cap, an internally threaded member disposed on an underside of a rear end and threadedly secured to the externally threaded shaft, and a stem disposed on an intermediate portion of the underside and slidably disposed in the groove; and a shoe disposed around an edge of the sole with the toe cap concealed;

wherein a clockwise rotation of the handle moves both the internally threaded member and the stem.

* * * * *